United States Patent [19]

Aspelin

[11] Patent Number: 4,825,151

[45] Date of Patent: Apr. 25, 1989

[54] WEAPON INTERFACE SYSTEM EVALUATOR

[75] Inventor: David J. Aspelin, Wichita, Kans.

[73] Assignee: The Boeing Company, Seattle, Wash.

[21] Appl. No.: 205,552

[22] Filed: Jun. 13, 1988

Related U.S. Application Data

[63] Continuation of Ser. No. 825,612, Feb. 3, 1986, abandoned.

[51] Int. Cl.[4] ..... G01R 31/02; G01R 29/02; F42C 11/00

[52] U.S. Cl. ..... 324/73 R; 324/158 R; 89/1.56; 89/1.819; 102/206

[58] Field of Search ..... 324/73 R, 73 AT; 89/1.56, 1.819, 1.813; 102/206; 371/20; 364/186

[56] References Cited

U.S. PATENT DOCUMENTS

| | | | |
|---|---|---|---|
| 2,851,660 | 9/1958 | Tobin et al. | 324/73 R |
| 3,619,792 | 11/1971 | Capeci et al. | 89/1.56 X |
| 4,494,438 | 1/1985 | Lighton et al. | 89/1.56 X |
| 4,586,436 | 5/1986 | Denney et al. | 102/206 X |
| 4,608,531 | 8/1986 | Stephens | 324/73 R |
| 4,649,821 | 3/1987 | Marshall et al. | 102/206 X |

*Primary Examiner*—Reinhard J. Eisenzopf
*Assistant Examiner*—Vinh P. Nguyen
*Attorney, Agent, or Firm*—Finnegan, Henderson, Farabow, Garrett & Dunner

[57] ABSTRACT

A weapon interface system evaluator and method for testing weapon carriage assemblies used with weapons and ejectors on military aircraft. The evaluator system is adapted for interfacing with a standard weapon system avionics box that responds to the aircraft's computer via a standard MIL. SPEC. data bus. The evaluator is easily deployed at forward military operating bases and under various temperature and weather extremes.

11 Claims, 4 Drawing Sheets

WEAPON INTERFACE SYSTEM EVALUATOR

This application is a continuation of application Ser. No. 825,612, filed Feb. 3, 1986, now abandoned.

BACKGROUND OF THE INVENTION

Heretofore, most present weapon systems have a set of avionics boxes and wiring that interface a weapon and an ejector to the aircraft's targeting computer and aircraft's power system. The avionics boxes and their wiring are often mounted on a weapon carriage assembly such as a wing-mounted pylon or a bomb-bay carrier launcher which is stored separate from the aircraft. Prior to loading the weapon carriage assembly on the aircraft, a functional test of the assembly is usually performed. In order to test the system, a separate test set has always been required. These prior test sets have traditionally been large items requiring a computer to control them. The test set's computers often have environmental operating limits and can operate only in a heated and cooled building or enclosure. These environmental limitations have meant that test sets are not easily deployable or useable in forward operating bases where a minimum of support equipment and facilities exist.

Prior attempts to build a test set have included devices that travel in an environmental igloo. These types of devices bring their own operating environment with them by providing a furnance or air conditioner to take care of temperature extremes and are housed in a portable enclosure that keeps dirt, wind, rain, etc. from impacting the equipment. Other test sets are not deployable. Such test sets are generally housed in a building and require weapon carriage assemblies to be brought to the housed test set. While the above test sets rarely fail in testing the weapon systems, they are not easily deployed at forward military operating bases.

In the following U.S. Pat. Nos. 3,609,312 to Higgins, 3,619,792 to Capeci, 3,710,350 to Yoshitake et al, 3,803,974 to Everest et al, 3,889,109 to Blessin, 3,920,973 to Avellar et al, 4,155,116 to Tawfik et al, 4,246,472 to Sun et al, 4,370,706 to Doniger et al, 4,494,438 to Liggton et al, various types of computer controlled systems are described for air launch weapons and aircraft control units, and self-diagnosing control systems used with household appliances. None of the above control systems provide the unique features and advantages of the subject weapon interface system evaluator as described herein.

SUMMARY OF THE INVENTION

The subject weapon interface system evaluator eliminates the need for complex support equipment and allows for operation indoors or outdoors over a wide temperature range. Further, the evaluator is easily deployable at forward military operating bases.

The weapon interface system evaluator uses the unique features of a weapon system avionics box that reports to an aircraft or other weapon transport/command vehicle's computer via a MIL STD 1553 data bus.

The weapon interface system evaluator includes an operator interface panel having a display with a lamp test button, self-test button and test-start button, and pass and, fail indicator or lights, and it is connected to a weapon system interface unit. The evaluator also includes the use of a ground power cart and a test cable adapted for engaging the weapon/ejector power switching unit.

The advantages and objects of the invention will become evident from the following detailed description of the invention when read in connection with the accompanying drawings which illustrate preferred embodiments of the invention.

DETAILED DESCRIPTION OF THE DRAWINGS

Figure 1:
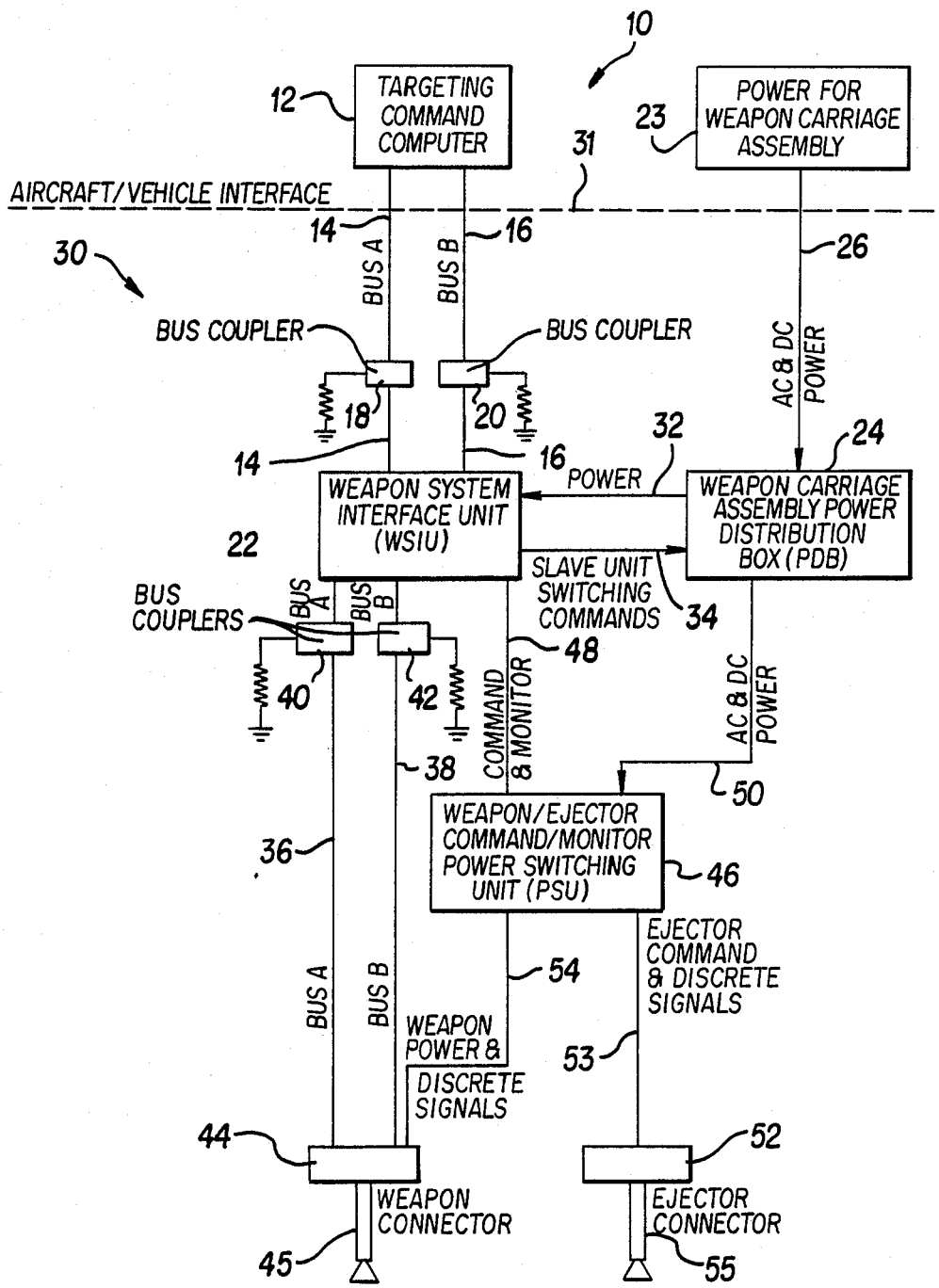
FIG. 1 PRIOR ART
FIG. 1 illustrates a prior art weapon system configuration.

FIG. 1 illustrates a MIL-STD-1760 weapon system avionics box that reports to an aircraft or any other weapon transport or command vehicle. The aircraft is indicated by general reference numeral 10. In FIG. 1, aircraft 10 is shown having a targeting/command computer 12, connected to a MIl-STD-1553 data bus having leads 14 and 16 connected to data bus couplers 18 and 20. The couplers, in turn, are connected to a weapon system interface unit (WSIU) 22. The aircraft 10 further includes a power source for a weapon carriage assembly indicated by numeral 23 to provide power to a weapon carriage assembly power distribution (PDB) 24 herein called PDB 24 via lead 26. The WSIU 22 and the PDB 24 are part of a weapon carriage assembly having a general reference numeral 30 and they are separated from the aircraft 10 by an aircraft/vehicle interface shown as line 31. The WSIU 22 and PDB 24 are connected via a power lead 32 and a slave unit switching command lead 34. The WSIU 22 further includes additional MIL-STD-1553 data buses 36 and 38 having couplers 40 and 42, respectively which are connected to a weapon connector 44 with weapon umbilical cable 45 used for connection to a weapon. The WSIU 22 is connected to a weapon ejector/command monitor power switching unit (PSU) 46 via a lead 48. PSU 46 is also connected to PDB 24 via lead 50 for receiving power from PDB 24. The PSU 46 is also connected to an ejector connector 52 via lead 53 and to the weapon connector 44 via lead 54. The ejector includes an ejector umbilical cable 55 used for connection to an ejector.

Figure 2:
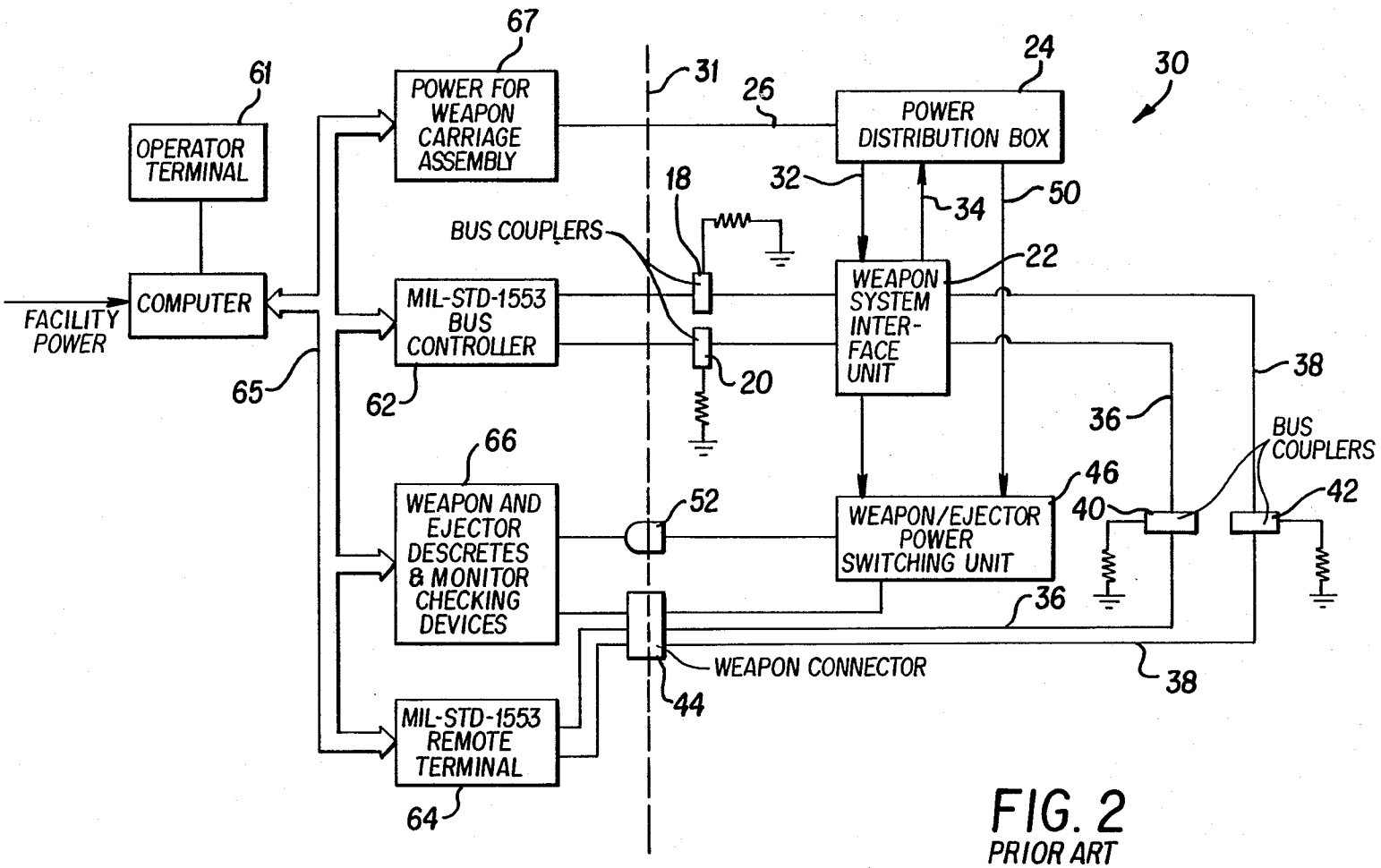
FIG. 2 PRIOR ART
FIG. 2 illustrates a prior art test set connected to a weapon carriage assembly.

FIG. 2 illustrates a prior art test set, 60 for the testing of the weapon carriage assembly 30. The assembly 30 is shown divided from the test set 60 by interface line 31.

The test set 60 uses a MIL-STD-1553 bus controller 62. The bus controller 62 commands the avionics box or, in this case, the weapon carriage assembly 30 with the standard WSIU 22. The test set 60 also uses a standard MIL-STD-1553 remote terminal 64 for connection to the weapon connector 44. The remote terminal 64 responds to the WSIU 22 as a missile would. Also, the set 60 includes a weapon and ejector monitoring device 66 to check the discretes used to talk and listen to signals from the weapon and it's ejector. The set further includes a terminal 61, computer 63, computer bus 65 and power source 67.

Figure 3:
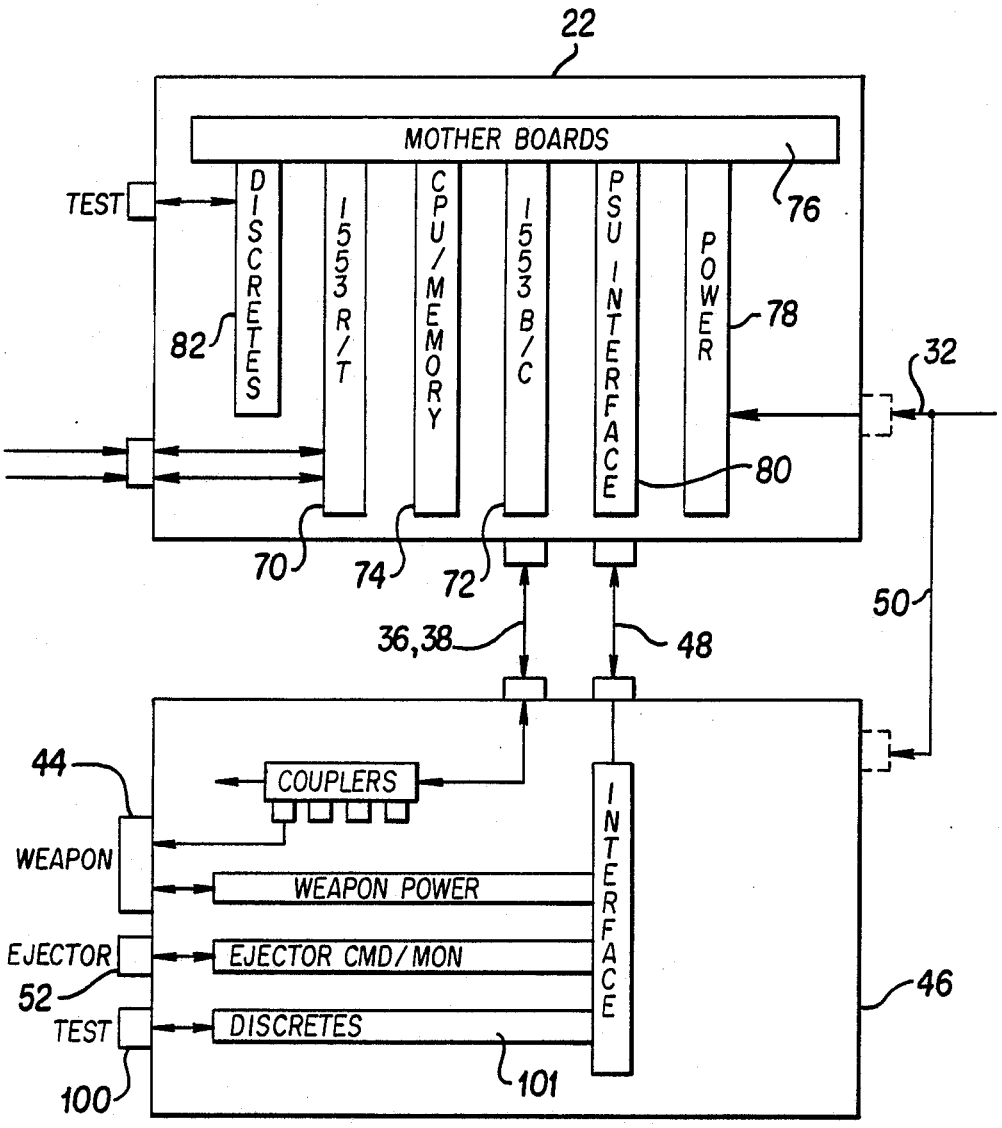
FIG. 3 PRIOR ART
FIG. 3 illustrates a simplified diagram of a weapon system interface unit and power switching unit.

Referring now to FIG. 3, it is of interest to note that a standard WSIU 22 has as one of its components a MIL-STD-1553 remote to terminal (R/T) 70 to communicate with aircraft 10. Also, it includes a MIL-STD-1553 bus controller (B/C) herein 72 and a central processing unit with memory CPU 74 all connected to a mother circuit board 76 The board 76 also includes a power circuit 78, power switching unit interface 80, and a discrete panel board 82.

Figure 4:
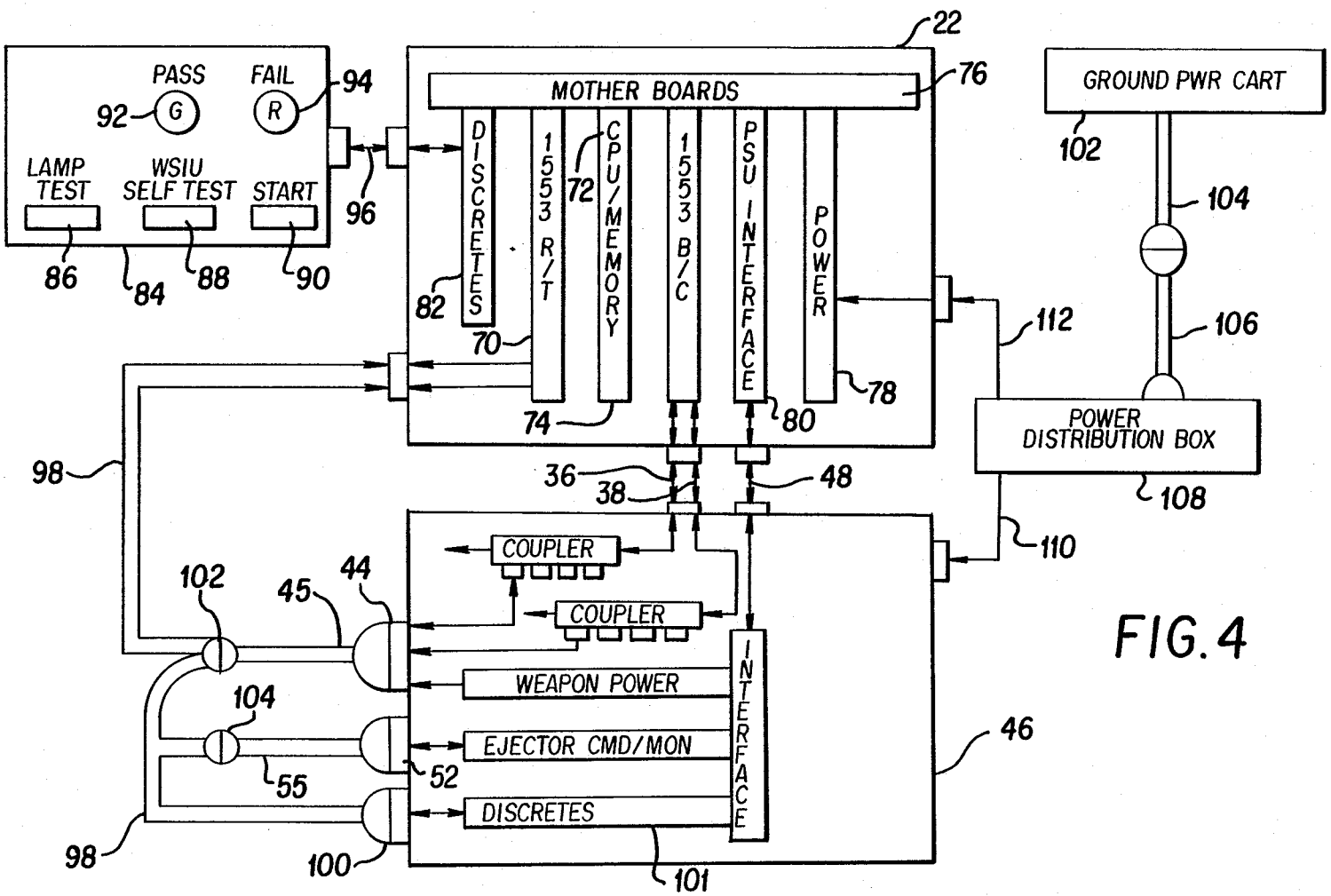
FIG. 4 illustrates the subject weapon interface system evaluator connected to the interface unit and power switching unit.

Referring now to FIG. 4, the subject invention having general reference numeral 82 is shown having an operator interface panel 84 with a lamp test button 86, a WSIU self-test button 88, and a test start button 90 with a pass indicator light 92 and a fail indicator light 94. The interface panel 84 is connected to the WSIU 22 via lead 96. A test adapter cable 98 is used for connection to the weapon umbilical cable 45, to an ejector umbilical cord 55, and to the discrete connection 100. The test adapter cable 98 is compatible with a standard MIL-STD-1553 bus having leads 14 and 16, as shown in FIGS. 1, 2 and 3. The evaluator 83 further includes a power source such as a ground power cart 102 having a AC/DC power lead 104 with adapter cable 106 for attachment to a power distribution box 108 which is in turn connected to the PSU 46 via lead 110 and to the WSIU 22 via lead 112.

The ground power cart power is turned on and the system is energized. The operator of the panel 84 presses the lamp test button 86 to check the pass/fail lights 92 and 94. When the lamp test is passed, the WSIU self-test button 88 is turned on and if pass indicator light 92 comes on the WSIU 22 passes the test. If the fail light indicator 94 comes on then the WSIU 22 is replaced. Next the adapter cable 98 is connected to the weapon and ejector cables 45 and 55. The test button 90 is turned on and the WSIU 22 is used to test the MIL-STD-1553 system and the weapon ejector discretes. If the test is satisfactory, the pass light 92 will come on. The fail light 94 will indicate a test problem. At this point, the wiring connections and connector pins are inspected and the test is rerun. A fail light again means that the PSU 46 should be replaced. A fail light after the PSU replacement means a WSIU fault has occured and the WSIU 22 should be replaced.

It should be noted that the evaluator 83 lets the CPU 74 command the MIL-STD-1553 B/C CPU 74 communicates signals talks through the system wiring and bus couplers and the signals are returned to the WSIU 22 and give instructions to the MIL-STD-1553 R/T 70. Thus, the CPU 74 will initiate a MIL-STD-1553 instruction with the B/C 72 and the message wraps back around and comes to the R/T 70 for evaluation. The wrap around nature of this concept allows the CPU 74 to receive with one device the message it sent via another. If a message error occurs, either a circuit fault or cable/coupler break would have occurred. A visual inspection of the coupler/cable for breaks or other damage would let the test operator of the evaluator 83 replace the suspect component and re-run the test. A failure of the same nature after a cable/coupler replacement would lead to the replacement of the suspect avionics box. The suspect avionics box would be removed for return to the maintenance depot. The only remaining signals that require testing are the weapon and ejector discretes. This can be done by adding circuits inside the PSU 46 that allow the CPU 74 in the WSIU 22 to read the discrete weapon and ejector outputs back into the PSU 46 using a wrap-around test cable. The test cable 98 wraps the signals at the end of the weapon and ejector umbilical connectors 102 and 104 back through the PSU test connector 100 to a discretes circuit board 101.

In summary and from reviewing the above-drawing descriptions, it can be appreciated that various types of weapon avionic boxes are readily adaptable to the subject weapon interface system evaluator 83. Further the dedicated test sets previously used can now be replaced through the use of the weapon interface system evaluator 83 having only a switch box and indicator panel 84 along with the adapter cable 98 and ground power such as a ground power cart 110, and a power distribution box provided the WSIU was programmed when conceived to contain the firmware routines necessary to interface with the panel 84 and utilize self-checking circuitry added to the system via discrete boards 82 and 101.

Changes may be made in the construction and arrangement of the parts or elements of the embodiments as decribed herein without departing from the spirit or scope of the invention defined in the following claims.

What is claimed is:

1. An apparatus for evaluating an operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and the distribution box and having a first port for communicating with the aircraft controller and a second port for communicating with one of the plurality of weapon systems, the power switching unit being coupled to the weapon system interface unit and to the power distribution box and having a port for communicating with and providing power to the one of the plurality of weapon systems and a corresponding one of the plurality of ejectors, and the power distribution box being coupled to an external power supply, said apparatus comprising:

input/output means removably coupled to the first port of the weapon sysem interface unit for generating a first test signal and providing said first test signal to the first port of the weapon system interface;

coupling means for removably coupling the port of the power switching unit to the second port of the weapon system interface unit; and processing means mounted in the weapon interface system and operatively coupled to the first port of the weapon system interface unit and to a selected portion of the weapon interface system to be tested for generating a second test signal in response to said first test signal and communicating said second test signal to said selected portion to cause said selected portion to communicate a response signal to said processing means corresponding to the state of said selected portion via said coupling means, and for generating an output signal in response to and corresponding to said response signal and communicating said output signal to said input/output means;

said input/output means including means responsive to said output signal for indicating the state of said selected portion.

2. An apparatus as recited in claim 1, wherein the input/output means includes an operator interface panel, said operator interface panel having at least one selector for generating the first test signal and at least one indicator for receiving the output signal from the weapon system interface unit and indicating the state of the selected portion in response to the output signal.

3. An apparatus as recited in claim 1, wherein the second test signal corresponds to an operational command from the aircraft controller.

4. An apparatus as recited in claim 1, wherein the processing means includes a central processing unit.

5. An apparatus as recited in claim 4, wherein the central processor unit is included in the weapon system interface unit.

6. An apparatus as recited in claim 4, wherein the selected portion includes a portion of the weapon system interface unit.

7. A method for evaluating an operational status of a weapon interface system for coupling an aircraft controller to a plurality of weapon systems and a corresponding plurality of weapon ejectors, the weapon interface system having a weapon system interface unit, a power switching unit, and a power distribution box, the weapon system interface unit being coupled to the power switching unit and to the distribution box and having a first port for communicating with the aircraft controller and a second port for communicating with one of the plurality of weapon systems, the power switching unit being coupled to the weapon system interface unit and to the power distribution box and having a port for communicating with and providing power to the one of the pluality of weapon systems and a corresponding one of the plurality of ejectors, and the power distribution boxy being coupled to an external power supply, said method comprising:

coupling an input/output device to the first port of the weapon system interface unit;

generating a first test signal and providing said first test signal to the first port of the weapon system interface unit using the input/output device;

providing a processing device in the weapon interface system;

generating a second test signal using the processing device in response to said first test signal and communicating said second test signal to a selected portion of the weapon interface system to cause said selected portion to communicate a response signal to said processing device corresponding to the state of said selected portion;

generating an output signal using said processing device in response to and corresponding to said response signal and communicating said output signal to said input/output device; and indicating the state of said selected portion using said input/output device in response to said output signal.

8. A method as recited in claim 7, wherein the selected portion includes a portion of the weapon system interface unit.

9. A method as recited in claim 7, wherein the selected portion includes a portion of the power switching unit.

10. A method as recited in claim 7, wherein said method further includes:

coupling the port of the power switching unit to the second port of the weapon system interface unit;

operatively coupling the processing device to the second port of the weapon system interface unit; and selecting the selected portion to cause the response signal to be communicated to the second port of the weapon system interface unit via the port of the power switching unit.

11. A method as recited in claim 10, wherein the first test signal corresponds to an operational command from the aircraft controller.

* * * * *

UNITED STATES PATENT AND TRADEMARK OFFICE

CERTIFICATE OF CORRECTION

PATENT NO. : 4,825,151

DATED : April 25, 1989

INVENTOR(S) : David J. Aspelin

It is certified that error appears in the above-identified patent and that said Letters Patent is hereby corrected as shown below:

Column 1, line 66, after "and" delete ",".

Column 2, line 64, change "it's" to --its--.

Claim 1, column 4, line 41, change "sysem" to --system--.

Signed and Sealed this

Twenty-sixth Day of December, 1989

*Attest:*

JEFFREY M. SAMUELS

*Attesting Officer* *Acting Commissioner of Patents and Trademarks*

UNITED STATES PATENT AND TRADEMARK OFFICE

CERTIFICATE OF CORRECTION

PATENT NO. : 4,825,151

DATED : April 25, 1989

INVENTOR(S) : DAVID J. ASPELIN

It is certified that error appears in the above-identified patent and that said Letters Patent is hereby corrected as shown below:

Column 1, before "BACKGROUND OF THE INVENTION" insert the following paragraph:

-- The U.S. Government has a paid-up license in this invention and the right in limited circumstances to require the patent owner to license others on reasonable terms as provided by the terms of Contract No. F33657-85-C-2097 awarded by Air Force Systems Aeronautical Command.--

Signed and Sealed this

Eleventh Day of December, 1990

*Attest:*

HARRY F. MANBECK, JR.

*Attesting Officer*

*Commissioner of Patents and Trademarks*